United States Patent [19]

Portmann

[11] 4,144,704

[45] Mar. 20, 1979

[54] SAFETY DEVICE FOR BATTERY-OPERATED WATCHES

[75] Inventor: Hubert Portmann, Colombier, Switzerland

[73] Assignee: Ebauches SA, Neuchatel, Switzerland

[21] Appl. No.: 602,389

[22] Filed: Aug. 6, 1975

[30] Foreign Application Priority Data

Aug. 30, 1974 [CH] Switzerland ..... 11819/74

[51] Int. Cl.[2] ..... G04C 3/00

[52] U.S. Cl. ..... 58/23 BA; 320/2

[58] Field of Search ..... 58/23 R, 23 BA, 50 R, 58/57.5, 152 H; 340/248 B, 249; 307/15; 320/2–4, 39

[56] References Cited

U.S. PATENT DOCUMENTS

| | | | |
|---|---|---|---|
| 3,427,797 | 2/1969 | Kimura | 58/23 BA |
| 3,680,072 | 7/1972 | Charbonnier | 340/249 |
| 3,802,182 | 4/1974 | Fujita | 58/23 BA |
| 3,832,629 | 8/1974 | Cernek | 340/249 |
| 3,858,389 | 1/1975 | Tsuruishi | 58/57.5 |
| 3,889,461 | 6/1975 | Marti | 58/23 BA |
| 3,898,790 | 8/1975 | Takamune | 58/23 BA |
| 3,979,656 | 9/1976 | Takeda et al. | 320/2 |

FOREIGN PATENT DOCUMENTS

| | | | |
|---|---|---|---|
| 2058798 | 5/1972 | Fed. Rep. of Germany | 58/152 H |

*Primary Examiner*—James R. Scott
*Assistant Examiner*—Vit W. Miska
*Attorney, Agent, or Firm*—Imirie, Smiley & Guay

[57] ABSTRACT

A safety device for battery-operated watches including an indicator device and an accumulator connected in parallel with the battery supplying the electronic circuit of the watch. The battery charges up the accumulator during normal use and when the battery runs down the indicator device gives a visual indication of battery condition and the accumulator continues to provide current to the electronic circuit of the watch for a time to enable the battery to be replaced.

9 Claims, 7 Drawing Figures

SAFETY DEVICE FOR BATTERY-OPERATED WATCHES

BACKGROUND OF THE INVENTION

The present invention relates to a safety device for battery-operated electronic watches.

The use of an electronic watch operating by battery has the disadvantage that the battery must be replaced periodically. In this respect, United States Patent application Ser. No. 465,347 describes an indicator for a watch which warns the user that the battery is at the end of its life and must be changed without delay. However, the user may perhaps not have at his disposal the time necessary for a change of battery before his watch stops. On the other hand, his watch will necessarily stop at the moment when he proceeds to change the battery: so in all cases, he will see himself obliged to re-set it to the correct time when a new battery is inserted.

SUMMARY OF THE INVENTION

In order to remove these disadvantages, the invention provides a safety device in parallel with the battery supplying the electronic circuit of the watch, comprising an accumulator which can be recharged with the aid of the battery by means of an electronic device indicating also the end of the life of the battery.

According to the present invention a safety device for battery-operated electronic watches comprises a battery, an accumulator in parallel with the battery, an electronic device connected to the battery and the accumulator in order to recharge the accumulator, the said electronic device also indicating the end of the life of the battery and including a switch capable of connecting the battery to the accumulator, the said switch being actuatable by a control circuit in dependence upon a voltage difference between the battery and the accumulator.

BRIEF DESCRIPTION OF THE DRAWINGS

The present invention will be described further, by way of example, with reference to the accompanying drawings, in which.

DETAILED DESCRIPTION

Figure 1:
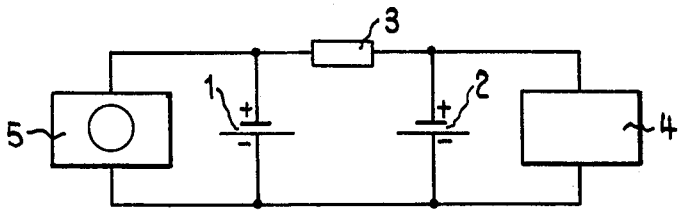
FIG. 1 is a block diagram of the device according to the present invention.

In FIG. 1 a battery 1 is arranged in parallel with an indicating device 5, and an accumulator 2 is placed in parallel with the electronic circuit 4 of the watch. The negative terminals of the battery 1 and of the accumulator 2 are connected directly to each other, whilst their positive terminals are connected via a resistance 3.

As long as the battery 1 is in good condition, it will deliver its current through the resistance 3 into the circuit 4 and simultaneously give a low maintenance current to the accumulator 2.

Figure 2:
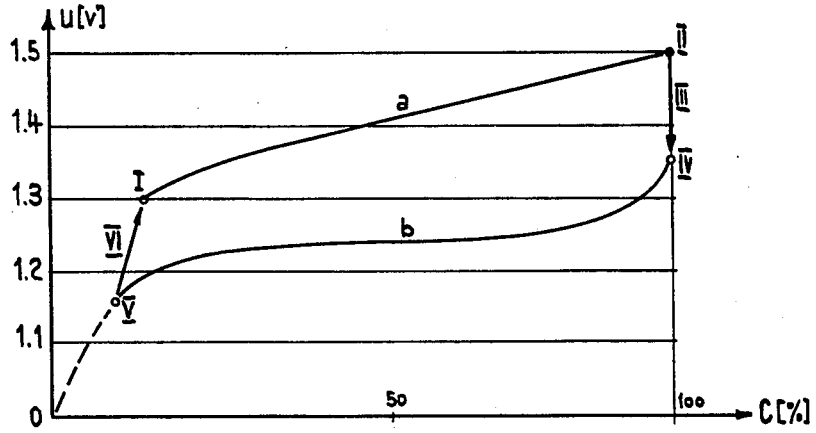
FIG. 2 is a set of curves which illustrates the behaviour of an accumulator which can be used in the device according to the invention.

In the diagram of FIG. 2 the voltage U at the terminals of the accumulator is illustrated varying with the charge C stored in the accumulator (in %). The curve a indicates the condition of the accumulator when it is charged and the curve b its condition when it is discharged. The voltage values U are indicated merely by way of example.

When the battery 1 reaches its end, its voltage starts to diminish and the accumulator 2 comes into service, delivering current to the circuit 4. The voltage of the accumulator and that of the battery will diminish in parallel very rapidly, the battery already being at its end and the accumulator, as arrow III of the diagram of FIG. 2 indicates, losing voltage very rapidly at the outset. If, in our example, the indicator 5 emits a signal of from 1.4 V, a relatively high charge which remains in the accumulator 2 can be counted on, the latter still being charged at almost 100%.

Referring to FIG. 2, we shall define hereafter four conditions governing the selection of the accumulator-battery combination, where:

$U_{II}$ = voltage at point II: voltage of the accumulator at maximum charge.

$U_{IV}$ = voltage at point IV: voltage of the accumulator at the start of the discharge.

$U_V$ = voltage at point V: voltage of the accumulator at the end of discharge.

$U_I$ = voltage at point I: voltage of the accumulator at the start of recharge.

(a) $U_{II} \geqq$ nominal voltage of the battery to avoid overloading.

(b) $U_{IV} <$ nominal voltage of the battery to obtain an indication of the end of the life of the battery rapidly.

(c) $U_V <$ minimum voltage necessary for the operation of the electronic circuit to avoid too low a discharge.

(d) $U_I >$ minimum voltage necessary for the operation of the electronic circuit in order that the watch can start again rapidly.

Figure 3:
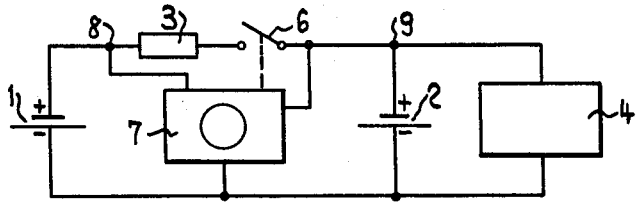
FIGS. 3 to 5 are block diagrams of other embodiments according to the invention.

FIG. 3 shows an improved embodiment wherein besides the battery 1, the accumulator 2, the electronic circuit 4 of the watch and the resistance 3, a switch 6 is included between the resistance 3 and the positive terminal 9. An indicator and control circuit 7 is connected between the positive terminal 8 of the battery and the negative terminal of the battery which is common to the entire device. The circuit 7 also has a connection to the positive terminal 9 of the accumulator and it can open and close the switch 6 (as indicated by a dotted line). The circuit 7 thus has two functions, the first consists of indicating the end of the life of the battery 1, and the second of controlling the switch 6. This control functions as the difference involtage between the points 8 and 9. A simple version can be imagined where the switch 6 remains closed until this difference in voltage is higher than a certain value $\Delta U$, $\Delta U$ being positive when the battery voltage is higher than the voltage of the accumulator. If, for example, the accumulator voltage must not exceed 1.4 V, whilst the nominal battery voltage is 1.5 V, $\Delta U = 100$ mV will be selected. The circuit 4 will be supplied by the accumulator 2 which will be recharged each time its voltage is lower than 1.4 V.

In another version, the switch 6 closes periodically only for a certain length of time (for example, 15 ms), the closure frequency being dependent upon the difference in voltage between the points 8 and 9. A very rapid recharge of the accumulator will thus be assured if the latter is well discharged. A stable rate of flow will be reached automatically where the frequency of closure of the switch 6, or in other words, the frequency of recurrence of the charging impulses, is sufficient to cover the energy requirements of the circuit 4. Thus, the possibility of the accumulator 2 providing all the necessary energy for a long time until it is recharged, will be avoided.

In the two cases, indication of the end of the life of the battery is carried out with the aid of the voltage measured at point 8 as described in the known Patent Application.

The control circuit of the switch 6 is of course integrated with the electronic circuit for indicating the end of the life of the battery, which gives the circuit 7. Naturally, it is conceivable to integrate the circuit 7 with its switch 6 in the watch circuit 4.

Figure 4:
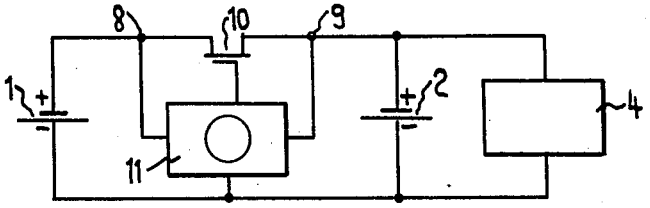
Figure 5:
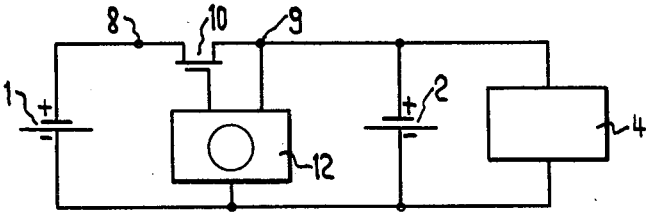

FIG. 4 shows another embodiment where the switch 6 and the resistance 3 have been replaced by a transistor 10. The conduction of this transistor 10 is directly proportional to the drop in voltage between the points 8 and 9. However, if this drop in voltage is below a threshold Δ U, the transistor 10 will be blocked. The system will stabilize itself so that the conduction of the transistor 10 is exactly sufficient for the consumption of the electronic circuit 4, so that a certain maintenance current will flow in the accumulator. In this respect, it is advantageous not to exploit fully the capacity of the accumulator. In fact, if from 70 to 80% of the nominal charge is sufficient, the maintenance current will be noticeably weaker. The control circuits 7 and 11 of FIGS. 3 and 4 utilized the difference in voltage between the battery and the accumulator to drive either the switch 6 or the transistor 10. In FIG. 5, there are again to be found the battery 1, the accumulator 2, the electronic circuit 4 and the transistor 10. A control circuit 12 utilizes only the value of the voltage at point 9 to drive the transistor 10 and eventually notify insufficient voltage. There then exists a zone (for example, between 1.35 V and 1.40 V) in which the conductance of the transistor 10 will be a function of the voltage at point 9, which ensures a stable rate of flow where the current in the accumulator will be at the lowest. As soon as the voltage at point 8 reaches the lower limit (—in which case the transistor 10 will conduct to the maximum) indication of the end of the life of the battery should be obtained. This indication must disappear from the moment when the transistor starts to reduce its conduction and when the maximum admissible voltage for the accumulator is reached, the transistor 10 must be blocked.

Figure 6:
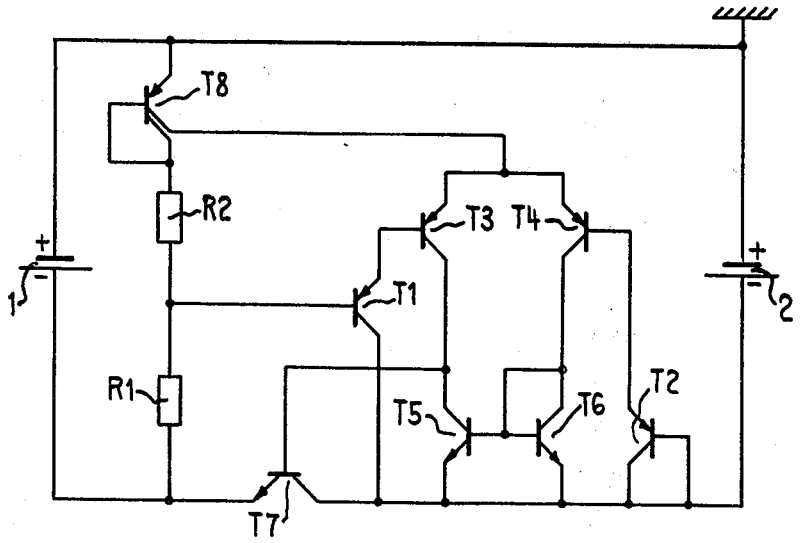
FIG. 6 is a schematic diagram of one exemplified embodiment of a control circuit of the device of FIG. 4.

FIG. 6 shows a form of a recharge circuit of an accumulator. It has been decided here to place the positive pole to earth, as is customary in electronic watches. This circuit takes as reference the difference between the battery and accumulator voltages: it is thus applicable to the case of FIG. 4. A multi-collector PNP transistor T8 whose emitter is connected to earth allows a weak current to flow in two resistances R1 and R2 connected in series on one of its collectors, the latter resistance R2 also being connected to the base of the transistor T8. The resistance R1 is connected to the negative terminal of the battery 1. The transistor T8 also serves as a source of current, through its second collector, for a differential amplifier formed by the transistors T1, T2, T3 and T4, one of the inputs of which, the base of T1, is connected between the resistances R1 and R2, whilst the other, the base of T2, is connected to the negative terminal of the accumulator 2. The collector of T8 is connected to the emitters of the PNP transistors T3 and T4, the respective bases of which are connected to the emitters of the PNP transistors T1 and T2 respectively, the collectors of these latter transistors being connected to the negative terminal of the accumulator 2. On the collectors of the transistors T3 and T4 there is furthermore placed a mirror of the current formed by the NPN transistors T5 and T6 whose emitters are connected to the negative terminal of the accumulator 2. The respective collectors of transistors T5 and T6 are connected to the collectors of the transistors T3 and T4; their bases are common and connected to the collector of T6. The collector of T3 finally drives the base of an NPN transistor T7 whose collector is connected to the negative terminal of the accumulator 2 and whose emitter is connected to the negative terminal of the battery 1.

The resistance R1 is selected in such a way that the voltage drop across it corresponds to Δ U, the difference in voltage between the battery and the accumulator which is desired. If the accumulator voltage diminishes, the transistors T1 and T3 will conduct more current than the transistors T2 and T4 and the potential at the output of the differential amplifier becomes more positive and polarizes the transistor T7 more satisfactorily which, in its turn, can supply a greater recharge current to the accumulator.

The device for indicating the end of the life of the battery can be completely independent, although certain elements, for example, those of polarization, can be common, in fact, this device takes the only voltage of the battery as reference.

Figure 7:
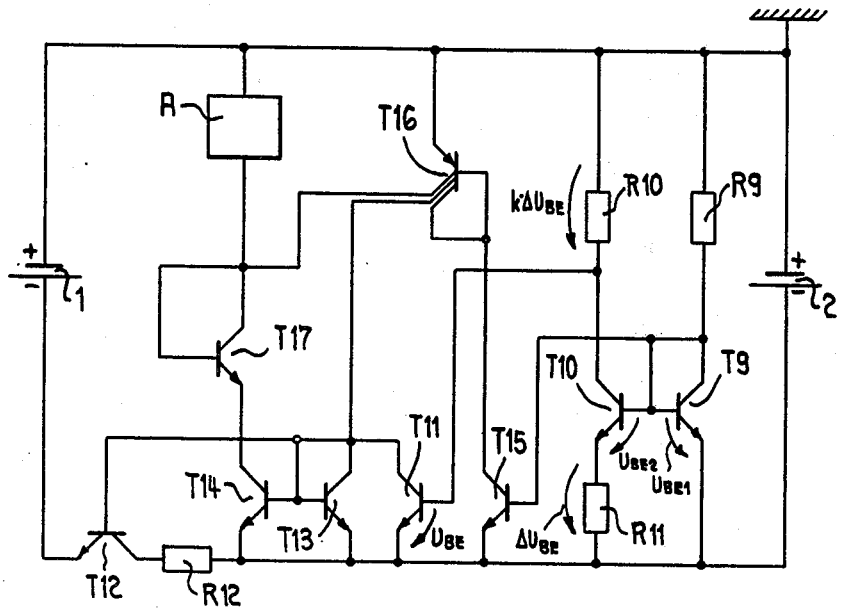
FIG. 7 is a schematic diagram of the control and indicating circuit of FIG. 5.

FIG. 7 shows a form where, for indicating the end of the life of the battery and for controlling the recharge of the accumulator, the circuit uses as reference the voltage at the accumulator. It is thus applicable to the case of FIG. 5. As in the previous case, the positive terminal is earthed.

Two NPN transistors T9 and T10 have their collectors connected to earth via resistances R9 and R10 respectively, their bases are common and connected to the collector of T9. The emitters of T9 and T10 are connected to the negative terminal of the accumulator 2 but the emitter of T10 is connected via a resistance R11. The transistor T9 is connected as a diode and the resistance R9 defines the current and consequently its base-emitter voltage $U_{BE1}$. The base-emitter voltage of the transistor T10 and $U_{BE2}$ must necessarily be smaller than $U_{BE1}$.

$$U_{BE1} - U_{BE2} = \Delta U_{BE}$$

This difference $\Delta U_{BE}$ will appear at the resistance R11. Consequently, if the resistance R10 is K times greater than the resistance R11, the drop in voltage at the resistance R10 will be: $K \cdot \Delta U_{BE}$. (We admit that the collector current is equal to the emitter current).

At the collector of T9 there is connected the base of an NPN transistor T15 whose collector polarizes a multi-collector PNP transistor T16. The emitter of T16 is connected to earth, and one of its collectors is connected to its base, the emitter of T15 is connected to the negative terminal of the accumulator 2. At the collector of T10 there is connected the base of an NPN transistor T11 whose collector is connected, on the one hand, to one of the collectors of T16, and on the other hand, to the collector of an NPN transistor T13 which is connected as a diode and whose emitter is connected to the negative terminal of the accumulator 2. The base of T13 is connected to the base of an NPN transistor T14, at the collector of which there is to be found in series, an indicator device A, one terminal of which is earthed, and and NPN transistor T17 which is connected as a diode. A third collector of T16 is connected between the indicator device A and the transistor T17. Finally, an NPN transistor T12, whose emitter is connected to the negative terminal of the battery 1 and whose collector is connected across a resistance R12 to the negative terminal of the accumulator 2, has its base connected at the collector of the transistor T13. The reference system formed by the transistors T9, T10 and T11 and by the resistances R9, R10 and R11 is known. By combining the multiple of a difference in diode voltage $\Delta U_{BE}$ with a diode voltage $U_{BE}$ (base-emitter voltage of the transistor T11), the system is compensated in temperature.

If the accumulator voltage is sufficient, the transistor T11 will conduct well, the current coming from the collector of the transistor T16, its collector voltage will be close to its emitter voltage (= voltage at the negative terminal of the accumulator 2). In this case, the transistors T13 and T14 are blocked and the transistor T12 likewise, on condition, however, that the voltage at the battery is not too much above the voltage of the accumulator. If the accumulator voltage becomes inadequate, the transistor T11 switches off. The current supplied by the collector of T16 will polarize the transistor T12, on condition however, that the voltage of the battery 1 is greater than the voltage of the accumulator. The small resistance R12 ensures this condition even if T12 is strongly conducting. If the voltage of the battery becomes inadequate and if, consequently, the drop in voltage at the resistance R12 disappears, the current supplied by T16 will also be able to polarize the transistors T13 and T14 and the latter will permit a current to pass into the indicator device A. The transistor T17 serves to diminish the maximum voltage which may appear on the indicator device A. The third collector of T16 connected between the transistor T17 and the indicator device A supplies a small discharge current, so that the indicator device A can discolor if T14 returns to the blocked state (with a new battery of sufficient voltage). The indicator of the end of the life of the battery can comprise a point formed by an electroluminescent diode of a color which is different from that of the indication, this diode lighting up when the battery voltage falls below a certain threshold.

I claim:

1. A safety device for battery-operated electronic watches comprising:

a battery, an accumulator, switch means adapted to connect said accumulator in parallel with the battery, said switch means being connected in series directly between the battery and the accumulator, and an electronic device connected at least to the accumulator and being adapted to control said switch means in order to regulate the current delivered from said battery to said accumulator in dependence upon a predetermined voltage, the said electronic device being also adapted to drive a device indicating the end of life of the battery.

2. A safety device according to claim 1, wherein closure of the switch means is discontinuous, its frequency being regulated by the control circuit, varying with the difference in voltage between the battery and the accumulator.

3. A safety device according to claim 1, wherein said predetermined voltage is the voltage difference between said battery and said accumulator voltages.

4. A safety device according to claim 1, wherein said predetermined voltage is the accumulator voltage.

5. A safety device according to claim 1, wherein said switch means is a transistor adapted to be controlled to connect the battery to the accumulator.

6. A safety device according to claim 5, wherein the control circuit regulates the conductance of the said transistor, varying with the difference in voltage between the battery and the accumulator.

7. A safety device according to claim 5, wherein the control circuit regulates the conductance of the said transistor, varying with the voltage at the terminals of the accumulator.

8. A safety device for battery-operated electronic watches comprising a battery;

an accumulator;

switch means adapted to connect said accumulator in parallel with the battery and comprising a transistor; and an electronic device to regulate the conductance of said transistor and hence the recharging of the accumulator, said regulation varying with the difference in voltage between said battery and said accumulator, said device comprising a differential amplifier having one input thereof connected at least indirectly to a first terminal of the battery, and a second input thereof connected to said first terminal of the battery through said transistor, said transistor being driven by the differential amplifier, said electronic device being also adapted to drive a device indicating the end of life of the battery.

9. A safety device for battery-operated electronic watches comprising a battery;

an accumulator;

switch means adapted to connect together the terminals of identical polarity of the battery and of the accumulator, said switch means comprising a transistor in series with a resistance; and an electronic device to regulate the conductance of said transistor in dependence upon the voltage at the terminals of said accumulator, said electronic device being connected to the terminals of the accumulator and adapted to drive a device indicating the end of life of the battery.

* * * * *